US008638290B2

(12) United States Patent
Kim et al.

(10) Patent No.: US 8,638,290 B2
(45) Date of Patent: Jan. 28, 2014

(54) BACKLIGHT APPARATUS AND DISPLAY APPARATUS INCLUDING THE SAME

(75) Inventors: Tae-hoon Kim, Suwon-si (KR); Sung-jin Choi, Gunpo-si (KR); Pankaj Agarwal, Suwon-si (KR); Joon-hyun Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 576 days.

(21) Appl. No.: 12/761,797

(22) Filed: Apr. 16, 2010

(65) Prior Publication Data

US 2011/0057960 A1 Mar. 10, 2011

(30) Foreign Application Priority Data

Sep. 8, 2009 (KR) ..... 10-2009-0084528

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS 4,975,692 A * 12/1990 Tateyama ..... 345/102
6,891,525 B2 * 5/2005 Ogoro ..... 345/102
7,777,425 B2 * 8/2010 Hsu et al. ..... 315/282
7,777,704 B2 * 8/2010 S et al. ..... 345/82
2003/0063081 A1 * 4/2003 Kimura et al. ..... 345/211
2006/0284569 A1 12/2006 Wey et al.
2007/0097067 A1 * 5/2007 Yoo ..... 345/102
2007/0262724 A1 * 11/2007 Mednik et al. ..... 315/125
2009/0207123 A1 * 8/2009 Kim et al. ..... 345/102

FOREIGN PATENT DOCUMENTS

WO 2008041153 A1 4/2008

OTHER PUBLICATIONS

Communication dated Dec. 21, 2010, issued in corresponding European Patent Application No. 10163822.9.
Werner Thomas et. al.: "Buck-boost converter topology for paralleling HB-LEDs using constant-power operation", Power Electronics and Drive Systems, PEDS 2009. International Conference on, IEEE, Piscataway, NJ, USA, Jan. 2, 2009 pp. 568-573, XP031614512, ISBN: 978-1-4244-4166-2.

* cited by examiner

*Primary Examiner* — Chanh Nguyen
*Assistant Examiner* — Roy Rabindranath
(74) *Attorney, Agent, or Firm* — Sughrue Mion, PLLC

(57) ABSTRACT

A backlight apparatus and a display apparatus are provided. The backlight apparatus includes N first switch units to switch a plurality of currents flowing in respective N light emitting element arrays according to an input brightness control signal, N second switch units to switch a plurality of currents flowing in respective N capacitors according to the input brightness control signal, and a reference current generation unit to generate and output a reference current based on the input brightness control signal. An inverter unit adjusts a total current supplied to all of the light emitting element arrays in total to be equal to the reference current if the total current is different from the reference current.

18 Claims, 10 Drawing Sheets

Worst case

BACKLIGHT APPARATUS AND DISPLAY APPARATUS INCLUDING THE SAME

CROSS-REFERENCE TO RELATED APPLICATIONS

This application claims priority from Korean Patent Application No. 10-2009-84528, filed on Sep. 8, 2009, in the Korean Intellectual Property Office, the disclosure of which is incorporated herein by reference in its entirety.

BACKGROUND

1. Field

Methods and apparatuses consistent with exemplary embodiments relate to a backlight apparatus and a display apparatus including the same, and more particularly, to a backlight apparatus which is capable of providing local dimming and a display apparatus including the same.

2. Description of the Related Art

With the development of information processing technology, techniques to display information have been rapidly developed. Due to the development of display technology, consumer demand for cathode-ray tube (CRT) displays is noticeably reduced, whereas consumer demand for flat panel displays such as a liquid crystal display (LCD) is greatly increased.

An LCD transmits light generated by a light source of a rear surface to a panel of a front surface, using a change in permeability of a liquid crystal according to voltage applied to the panel, thereby providing an image for a user. That is, since the LCD is unable to emit light by itself, it requires a backlight as a light source.

In particular, considering that light emitting diodes (LEDs) are environment-friendly and have merits of a high speed response time of several nano seconds and long lifespan, the LEDs are increasingly employed as a light source for a backlight of an LCD panel.

However, since the light sources for the backlight are distributed over the LCD panel, an improved driving circuit technique to prevent brightness imbalance caused by the distribution of light sources is required. Some techniques to prevent the brightness imbalance require many components such as plural linear regulators or boost converters and thus may result in an ineffective system configuration. Furthermore, with such increased number of components, the space occupied by the driving circuitry increases, making it more difficult to achieve lightness and slimness of the LCD backlight. Also, in a backlight apparatus to solve the above problems, there is a problem that it is difficult to realize local dimming.

Therefore, there is a need for a method to solve the problems of brightness imbalance, which is caused by distribution of light sources, and difficulty in achieving lightness and slimness of an LCD panel, and also to provide local dimming.

SUMMARY

Exemplary embodiments overcome the above disadvantages and other disadvantages not described above. Also, the exemplary embodiment is not required to overcome the disadvantages described above, and may not overcome any of the problems described above.

One or more exemplary embodiments provide a backlight apparatus including N number of first switch units to switch the currents flowing in N number of light emitting element arrays according to an input brightness control signal, N number of second switch units to switch the currents flowing in N number of capacitors according to the input brightness control signal, and a reference current generation unit to generate and output a reference current based on the input brightness control signal, and a display apparatus including the backlight apparatus.

According to an aspect of an exemplary embodiment, there is provided a backlight apparatus including N light emitting element arrays, wherein each of the N light emitting element arrays comprises a predetermined number of light emitting elements and N is a natural number greater than or equal to 1, N capacitors which are connected in parallel to the N light emitting element arrays, a brightness control signal input unit which receives a brightness control signal to adjust brightness of the N light emitting element arrays, N first switch units which switch a plurality of currents flowing in the respective N light emitting element arrays, according to the input brightness control signal, N second switch units which switch currents flowing in the N capacitors, according to the input brightness control signal, a reference current generation unit which generates and outputs a reference current based on the input brightness control signal, and an inverter unit which adjusts a total current supplied to all of the light emitting element arrays to be equal to the reference current if the total current is different from the reference current.

The reference current generation unit may generate a reference current of an amount which is determined according to the number of light emitting element arrays that are turned on among the N light emitting element arrays, by referring to the input brightness control signal.

The backlight apparatus may further include: N number of balancing units which balance an input alternating current (AC) by impedance balancing, and N rectification units which rectify the input alternating currents balanced by the N balancing units, thereby generating a direct current (DC), and supply the DC to each of the N light emitting element arrays.

The N balancing units may be connected in parallel to one another.

The N first switch unit may be connected in series to a respective one of the light emitting element arrays, and each of the N second switch units may be connected in series to a respective one of the N capacitors.

The N balancing units may be connected in series to one another.

Each of the N first switch unit may be connected in series to a respective one of the N light emitting element arrays, and each of the N second switch unit may be connected in parallel to a respective on of the N capacitors.

The backlight apparatus may further include a subtraction unit which outputs a differential current corresponding to a difference between the total current supplied from the inverter unit and the reference current generated by the reference current generation unit, and the inverter unit may adjust the total current according to the differential current.

The inverter unit may adjust the total current by adjusting a duty or a frequency of the total current.

The brightness control signal may be a dimming or scanning signal.

The light emitting element may be a light emitting diode (LED).

According to an aspect of another exemplary embodiment, there is provided a display apparatus including the above-described backlight apparatus.

BRIEF DESCRIPTION OF THE DRAWING FIGURES

The above and/or other aspects will be more apparent by describing in detail exemplary embodiments, with reference to the accompanying drawings in which.

DETAILED DESCRIPTION OF THE EXEMPLARY EMBODIMENTS

Figure 1:
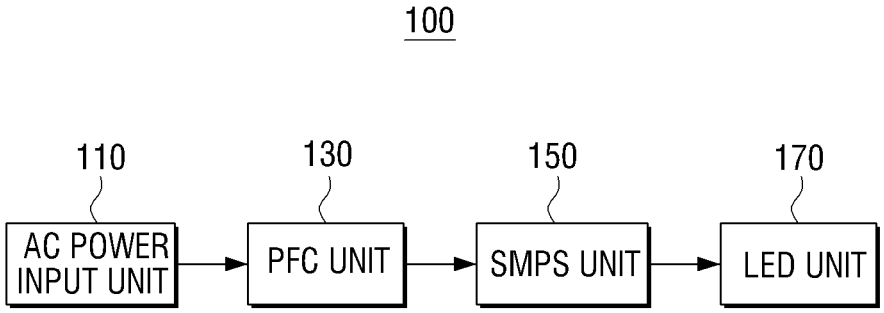
FIG. 1 is a block diagram illustrating a backlight apparatus according to an exemplary embodiment.

Hereinafter, the exemplary embodiments will be described in greater detail with reference to the accompanying drawings, in which exemplary embodiments are shown.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

FIG. 1 is a block diagram illustrating a backlight apparatus 100 according to an exemplary embodiment. The backlight apparatus 100 according to an exemplary embodiment is capable of providing a user with an image of uniform brightness and also providing local dimming. The local dimming refers to a technique to adjust brightness of backlight of light emitting elements included in the backlight apparatus 100 according to the brightness of a currently displayed image. Since the local dimming results in a high contrast ratio of a displayed image, a display apparatus can provide a high quality image.

As shown in FIG. 1, the backlight apparatus 100 includes an AC power input unit 110, a power factor correction (PFC) unit 130, an SMPS unit 150, and an LED unit 170.

The AC power input unit 110 transmits AC power input from an external source (not shown) to the PFC unit 130.

The PFC unit 130 rectifies a current and improves a power factor. The PFC unit 130 improves the power factor of the AC power input from the AC power input unit 110 to supply a stable current to each component of the backlight apparatus 100 or a display apparatus including the backlight apparatus 100. Accordingly, the PFC unit 130 prevents an increase of temperature or an increase of power consumption which is caused by conversion of a wasted current to heat. Also, the PFC unit 130 converts the input AC power into DC power and transmits the DC power to the SMPS unit 150.

The SMPS unit 150 generates DC power of a desirable form (level) using the DC power input from the PFC unit 130. The SMPS unit 150 generates AC power using the input DC power through a switching operation of an inverter unit, converts the AC power into desirable voltage (current), and rectifies the voltage (current), thereby generating DC power.

In particular, the SMPS unit 150 generates balanced and rectified DC power such that the currents input to N LED arrays provided in the LED unit 170 are adjusted to be equal to one another where N is a natural number greater than or equal to 1. Detailed inner configuration and operation of the SMPS unit 150 will be explained below with reference to the drawings.

The SMPS unit 150 transmits the balanced and rectified DC power to the LED unit 170. The LED unit 170 is driven according to the DC power input from the SMPS unit 150 to emit backlight. The LED unit 170 includes N number of LED arrays 240. That is, the LED unit 170 includes N LED array channels. The LED array refers to a plurality of LEDs which are continuously arranged. The LED arrays include a red LED array, a green LED array, and a blue LED array, and are arranged in a manner that the light emitted from the red LED array, the light emitted from the green LED array, and the light emitted from the blue LED array are mixed with one another such that white light is emitted.

Also, the LED unit 170 controls the on/off state of each of the N LED arrays 240 according to an input brightness control signal, thereby performing local dimming. Method and configuration of the LED unit 170 to provide local dimming will be explained later with reference to FIGS. 2 to 6.

As described above, the backlight apparatus 100 is capable of providing backlight of uniform brightness and also providing local dimming.

Figure 2:
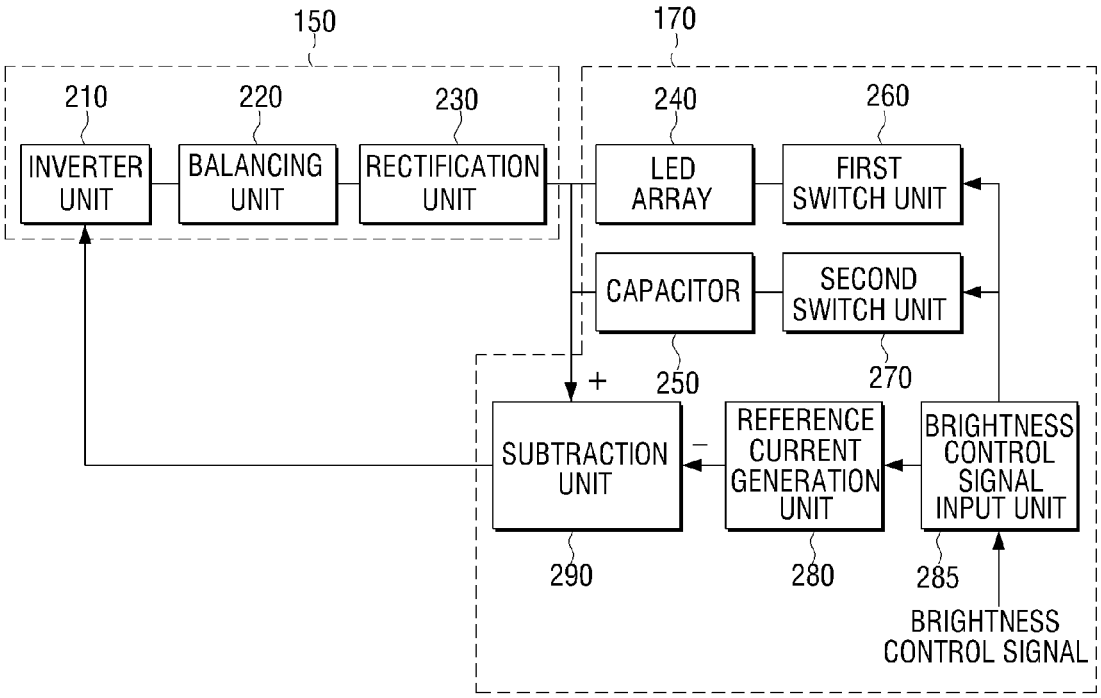
FIG. 2 is a detailed block diagram illustrating a switching mode power supply (SMPS) unit and an LED unit according to an exemplary embodiment.

FIG. 2 is a block diagram illustrating the SMPS unit 150 and the LED unit 170 in detail according to an exemplary embodiment. As shown in FIG. 2, the SMPS unit 150 includes an inverter unit 210, a balancing unit 220, and a rectification unit 230.

The inverter unit 210 performs high frequency chopping to convert a DC into an AC. The inverter unit 210 transmits the converted AC to the balancing unit 220.

The balancing unit 220 performs AC balancing to adjust the AC, which are to be output to the LED arrays 240, to be equal to one another. The number of balancing units 220 is N which is the same as the number of LED arrays 240. The balancing unit 220 applies the balanced AC to each of the N rectification units 270.

Also, the balancing unit 220 may include a transformer at its front end. The transformer converts a primary AC into a secondary AC. More specifically, the transformer induces the primary AC to be the secondary AC according to a turn ratio of a primary coil to a secondary coil. The transformer transmits the secondary AC to each of the balancing units 220.

The rectification unit 230 rectifies the balanced AC and generates DC of the same level. The number of rectification units 230 is N which is the same as the number of LED arrays 240. The rectification units 230 transmit the generated DC to the N number of LED arrays 240.

Accordingly, the SMPS unit 150 provides the balanced and rectified DC to the LED arrays 240, thereby solving the brightness imbalance caused by distribution of LED arrays.

Also, in order to realize local dimming with respect to the backlight apparatus 100 including the SMPS unit 150 having the configuration described above, the LED unit 170 switches the LED arrays 240 using a switch.

To accomplish this, the LED unit 170 includes the LED arrays 240, capacitor(s) 250, first switch unit(s) 260, and second switch unit(s) 270.

The N number of LED arrays 240 includes N channels. The LED array refers to an arrangement of LEDs including a predetermined number of LEDs which are continuously arranged. The LED arrays include a red LED array, a green LED array, and a blue LED array, and are arranged in a manner wherein the light emitted from the red LED array, the light emitted from the green LED array, and the light emitted from the blue LED array are mixed with one another such that white light is emitted.

The N LED arrays 240 are driven by DC supplied from the rectification units 230. Also, the N LED arrays 240 are switched by the N first switch units 260. That is, if a first switch unit 260 is turned on, a corresponding LED array 240 is turned on. If a first switch unit 260 is turned off, a corresponding LED array 240 is turned off.

The capacitor 250 is connected to each of the N LED arrays 240 in parallel. The capacitor 250 stores the rectified power as DC.

The first switch unit 260 switches the current flowing in each of the N LED arrays 240 according to a brightness control signal which is input from a brightness control signal input unit 285. Accordingly, the number of first switch units 260 is N and each of the first switch units 260 is connected to each of the LED arrays 240 in series. The brightness control signal is a backlight control signal which is generated corresponding to brightness information of a video signal in order to provide local dimming. The brightness control signal includes on/off information regarding each of the N number of LED arrays 240. More specifically, the brightness control signal may be a dimming/scanning signal.

The first switch unit 260 is switched according to the on/off information of the brightness control signal regarding each of the N LED arrays 240. For example, if a brightness control signal for a specific LED array 240 indicates an "on-state", the specific LED array 240 is turned on, and, if a brightness control signal for a specific LED array 240 indicates an "off-state", the specific LED array 240 is turned off.

The first switch unit 260 uses diverse types of switches and may be a switch using a transistor for example.

As described above, the N first switch units 260 switches the N LED arrays 240, respectively, so that local dimming can be provided.

The second switch unit 270 switches the current flowing in each of the N capacitors 250 according to the brightness control signal which is input from the brightness control signal input unit 285. Therefore, the number of second switching units 270 is N and each of the second switching units 270 is connected to each of the LED arrays 240 in series or in parallel. More specifically, if the N balancing units 220 are connected to one another in parallel, the second switch units 270 are connected to the capacitors 250 in series (see FIGS. 3 and 5). On the other hand, if the N balancing units 220 are connected to one another in parallel, the second switch units 270 are connected to the capacitors 250 in series (see FIGS. 4 and 6).

The capacitor 250 is used to store DC power. However, even when the LED array 240 is turned off, tailing current may still flow in the LED array 240 due to the inflow of power remaining in the capacitor 250. Also, when the SMPS unit 150 is operated in order to turn on the LED array 240, no current flows in the LED array 240 while the capacitor is charged with voltage, causing a "turn on delay" in the LED array 240. In order to prevent this problem, the second switch unit 270 switches the current flowing in the capacitor 250.

The brightness control signal input unit 285 receives a brightness control signal to adjust the brightness of the N LED arrays 240. The brightness control signal input unit 285 transmits the brightness control signal to the first switch units 260, the second switch units 270, and a reference current generation unit 280.

The reference current generation unit 280 generates a reference current based on the input brightness control signal. The inverter unit 210 supplies a suitable amount of current according to the number of LED arrays 240. For example, the inverter unit 210 may supply N*I amount of current to the N LED arrays 240 (I is a current value necessary for a single LED array). Therefore, N*I amount of current flows in the circuit of the LED unit 170. However, if two of the N LED arrays 240 are turned off, the N*I amount of current is supplied to (N−2) LED arrays 240, so there is a change in the current supplied to a single LED array 240, causing distortion in the brightness. Therefore, it is necessary to adjust the total amount of current to be (N−2)*I so that a current of a constant current value I flows in a single LED array 240.

Accordingly, by referring to the input brightness control signal, the reference current generation unit 280 generates a reference current of an amount which is determined according to the number of LED arrays 240 that are turned on among the N LED arrays 240. That is, the reference current generation unit 280 generates a reference current having a current value in proportion to the number of LED arrays 240 that are turned on. The reference current generation unit 280 outputs the generated reference current to a subtraction unit 290.

The subtraction unit 290 outputs a differential current which corresponds to a difference between the current supplied from the inverter unit 210 and the reference current generated by the reference current generation unit 280. That is, the subtraction unit 290 generates a differential current corresponding to a difference between the current flowing in the LED unit 170 and the reference current. The subtraction unit 290 outputs the differential current to the inverter unit 210.

The inverter unit 210 adjusts a supplied current according to the differential current. More specifically, the inverter unit 210 adjusts the supplied current by adjusting a duty or frequency of the current. This will be described below in detail with reference to FIG. 11.

As described above, the differential current is supplied to the inverter unit 210 through the reference current generation unit 280 and the subtraction unit 290 such that the inverter unit 210 supplies the amount of current corresponding to the number of currently turned-on LED arrays 240.

As described above, the backlight apparatus 100 is capable of providing a local dimming function using the N first switch units 260, the N second switch units 270, the reference current generation unit 280, and the subtraction unit 290.

Hereinafter, a simplified circuit and a detailed circuit of the SMPS unit 150 and the LED unit 170 are described with reference to FIGS. 3 to 6. Since the circuit of FIGS. 3 to 6 is similar to that of FIG. 2 in view of its function, explanation of overlapped portions is omitted.

Figure 3:
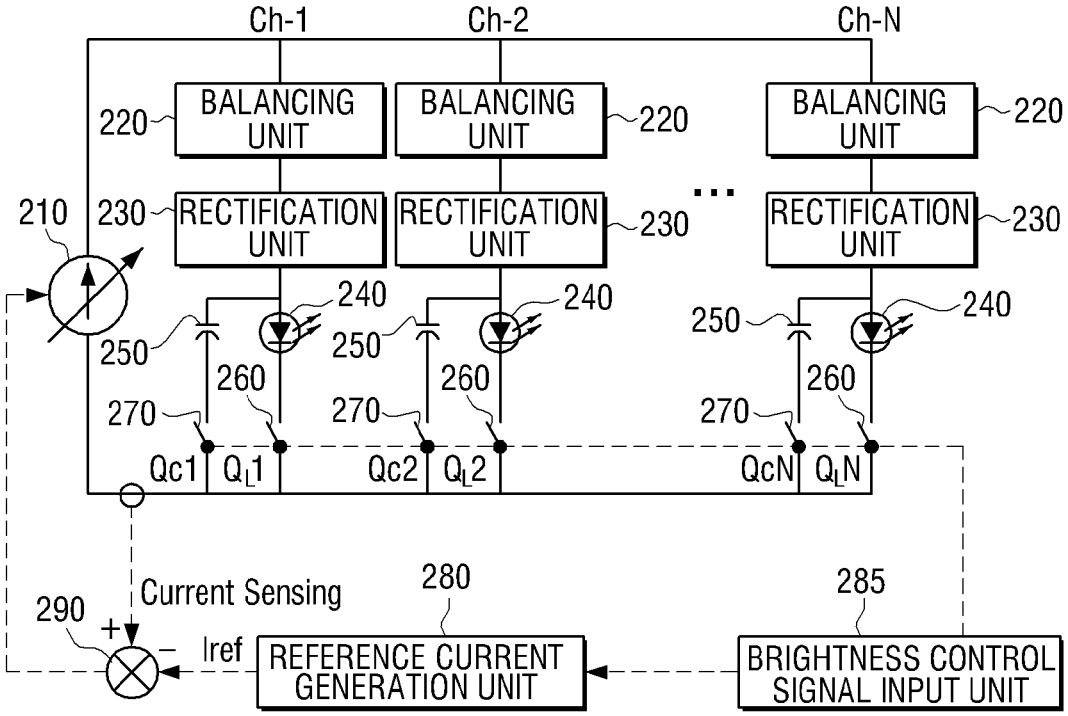
FIG. 3 is a circuit diagram illustrating an SMPS unit and an LED unit of a parallel method mode according to an exemplary embodiment.

FIG. 3 is a view schematically illustrating a circuit of the SMPS unit 50 and the LED unit 170 of a parallel method mode according to an exemplary embodiment. As shown in FIG. 3, the SMPS unit 150 and the LED unit 170 include N channels Ch-1, Ch-2, . . . , Ch-N in total. Also, a single channel includes a single balancing unit 220, a single rectification unit 230, a single LED array 240, a single capacitor 250, a single first switch unit 270, and a single second switch unit 280. The balancing unit 220 of each channel is connected to a balancing unit 220 of another channel in parallel.

Figure 5:
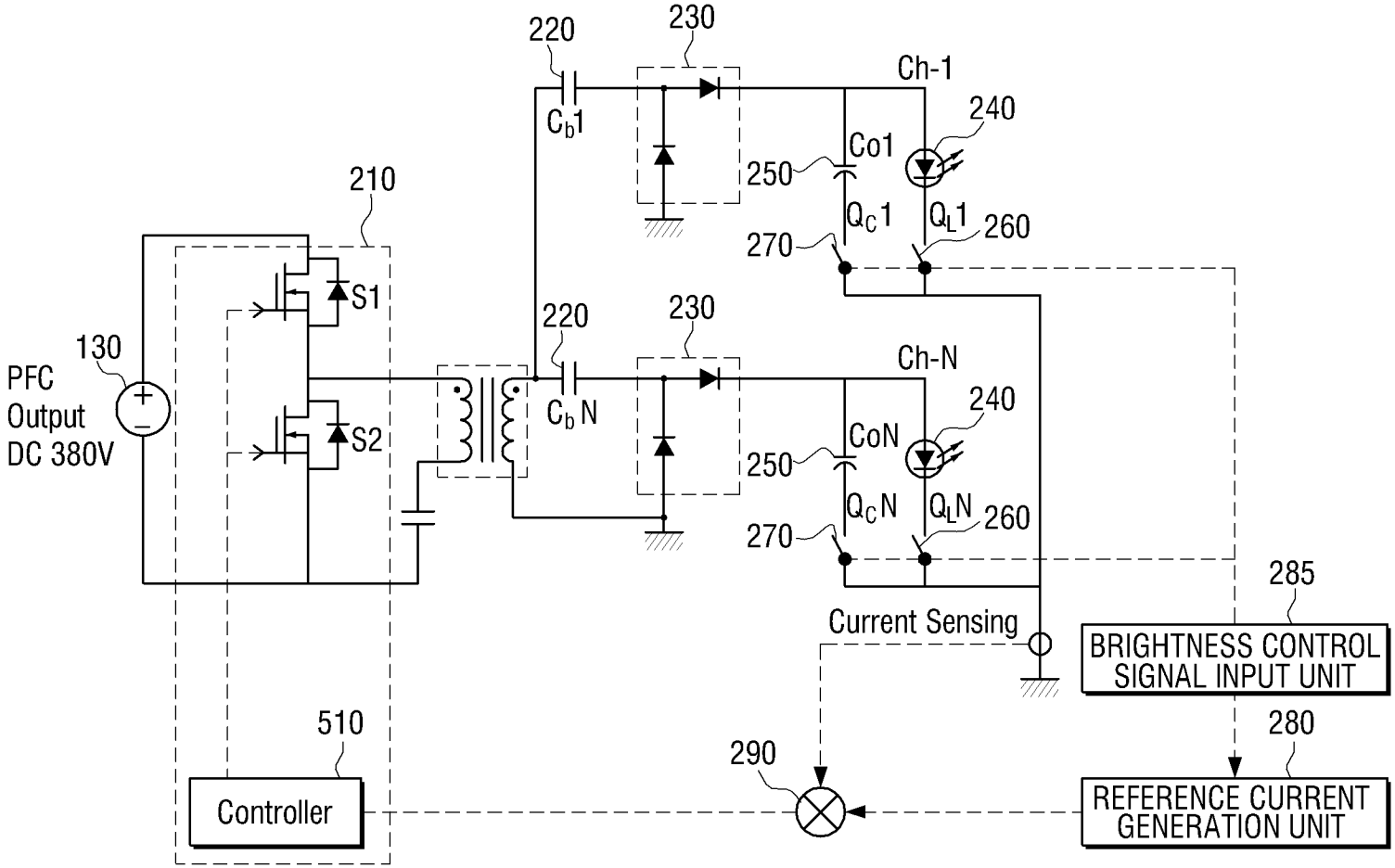
FIG. 5 is a circuit diagram illustrating the SMPS unit and the LED unit of the parallel method mode in detail according to an exemplary embodiment.

FIG. 5 is a view illustrating the circuit of the SMPS unit 150 and the LED unit 170 of the parallel method mode in detail.

As shown in FIG. 5, the inverter unit 210 includes two transistor switches S2, S2 and a controller 510.

The inverter unit 210 converts an input DC into an AC according to high frequency chopping which is based on opening and closing operations of the two transistor switches S1, S2. More specifically, if the upper switch S is closed and the lower switch S2 is opened, the DC input to opposite ends of the inverter unit 210 becomes a high level, and, if the lower switch S2 is closed and the upper switch S1 is opened, the DC input to the opposite ends of the inverter unit 210 becomes a low level. By repeating this operation rapidly, the inverter unit 210 converts the DC to a high frequency AC.

Also, the controller 510 controls a switching operation of the transistor switches S1, S2 to control the duty and frequency of the output current. If the controller 510 receives a differential current from the subtraction unit 290, the controller 510 outputs the amount of output current according to the differential current. Accordingly, the inverter unit 210 adjusts the amount of current using the two transistor switches S1, S2 and the controller 510.

As shown in FIG. 5, the balancing unit 220 includes a capacitor Cb1, . . . , CbN, and the rectification unit 230 includes two diodes.

As described above, in the backlight apparatus 100 shown in FIGS. 3 and 5, each channel is connected to another channel in parallel. If the channels are connected to one another in parallel, the first switch unit 260 is connected to the LED array 240 in series and the second switch unit 270 is also connected to the capacitor 250 in series.

Figure 4:
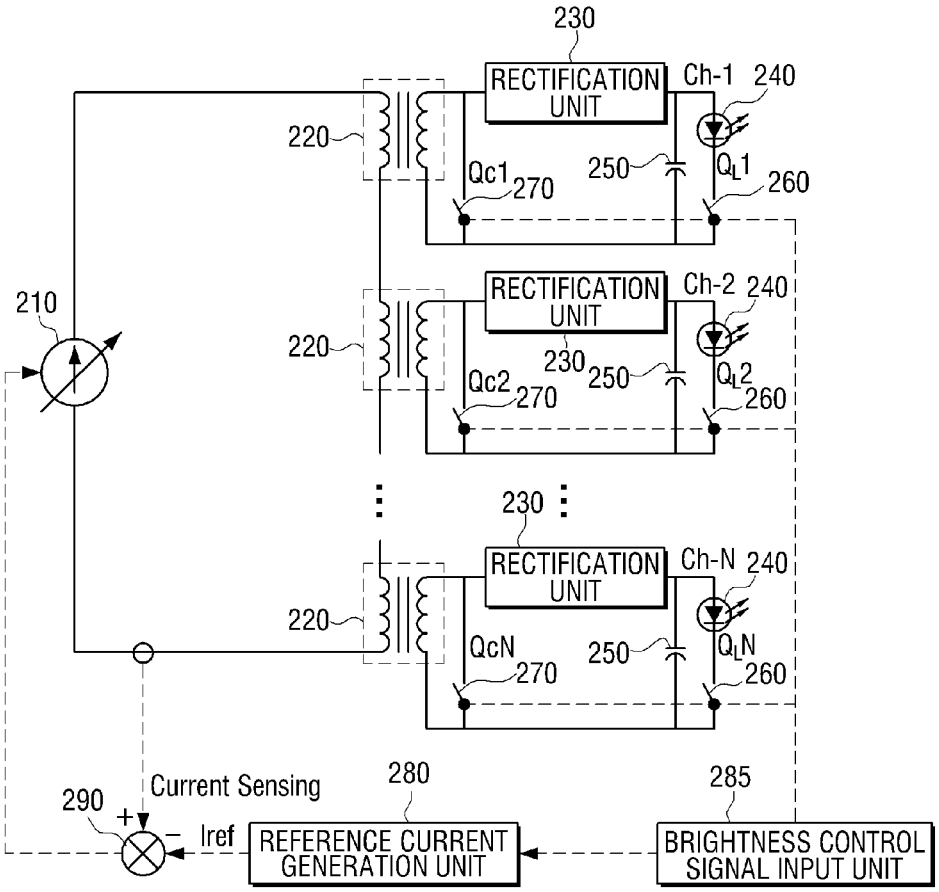
FIG. 4 is a circuit diagram illustrating an SMPS unit and an LED unit of a series method mode according to an exemplary embodiment.

FIG. 4 is a view schematically illustrating a circuit of the SMPS unit 150 and the LED unit 170 of a series method mode according to an exemplary embodiment. As shown in FIG. 4, the SMPS unit 150 and the LED unit 170 include N channels Ch-1, Ch-2, . . . , Ch-N in total. A single channel includes a singe balancing unit 220, a single rectification unit 230, a single LED array 240, a single capacitor 250, a single first switch unit 270, and a single second switch unit 280. The balancing unit of each channel is connected to a balancing unit of another channel in parallel. Also, in the exemplary embodiment of FIG. 4, the balancing unit 220 is realized as a single transformer.

Figure 6:
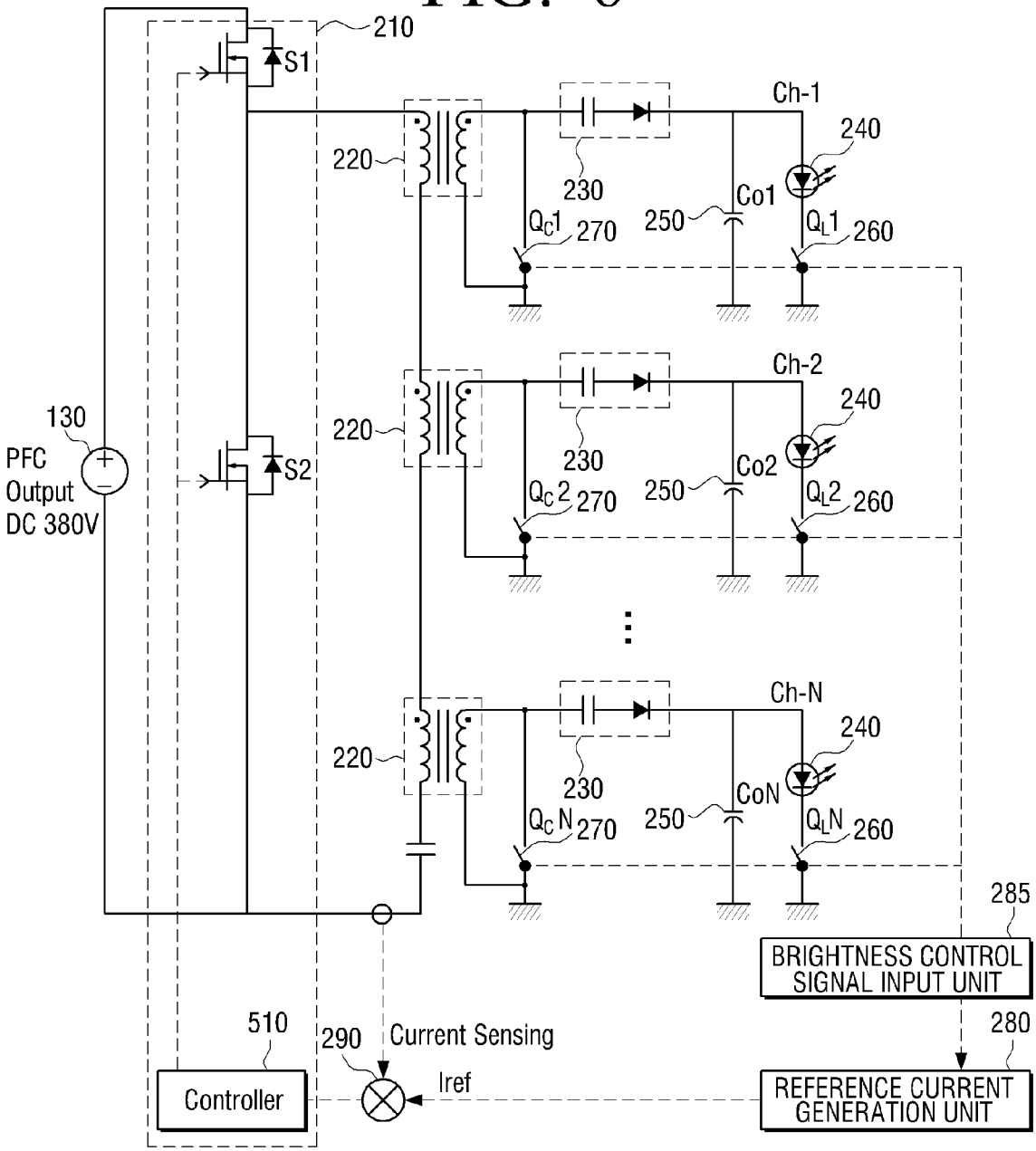
FIG. 6 is a circuit diagram illustrating the SMPS unit and the LED unit of the series method mode in detail according to an exemplary embodiment.

FIG. 6 is a view illustrating the circuit of the SMPS unit 150 and the LED unit 170 of the series method mode in detail. As shown in FIG. 6, the inverter unit 210 includes two transistor switches 51, S2 and a controller 510.

The inverter unit 210 converts an input DC to an AC according to high frequency chopping which is based on closing and opening operation of the two transistor switches S1, S2. More specifically, if the upper switch S1 is closed and the lower switch S2 is opened, the DC input to the opposite ends of the inverter unit 210 becomes a high level, and, if the lower switch S2 is closed and the upper switch S1 is opened, the DC input to the opposite ends of the inverter unit 210 becomes a low level. By repeating this operation rapidly, the inverter unit 210 converts the DC to a high frequency AC.

Also, the controller 510 controls a switching operation of the transistor switches S1, S2 to control the duty and frequency of the output current. Accordingly, if the controller 510 receives a differential current from the subtraction 290, the controller 510 adjusts the amount of output current according to the differential current. Accordingly, the inverter unit 210 adjusts the amount of current using the two transistor switches S1, S2 and the controller 510.

In the exemplary embodiment, the balancing unit 220 is a transformer and the primary side of each transformer is connected to a primary side of another transformer in series. Also, the rectification unit 230 includes a single capacitor and a single diode.

As described above, in the backlight apparatus 100 of FIGS. 4 and 6, the primary side of the transformer constituting the balancing unit of each channel is connected to the primary side of another transformer in series. If the channels are connected to one another in series, the first switch unit 260 is connected to the LED array 240 in series and the second switch unit 270 is connected to the capacitor 250 in parallel.

As described above, the SMPS unit 150 and the LED unit 170 are realized in a parallel method mode or a series method mode, and in either cases, the backlight apparatus 100 can realize local dimming using the first switch unit 260, the second switch unit 270, the reference current generation unit 280, and the subtraction unit 290.

Also, the backlight apparatus 100 can provide local dimming using the first switch unit 260, the second switch unit 270, the reference current generation unit 280, and the subtraction unit 290 even in the case that the SMPS unit 150 and the LED unit 170 have a circuit configuration other than the circuit configuration of FIGS. 5 and 6.

Figure 7:
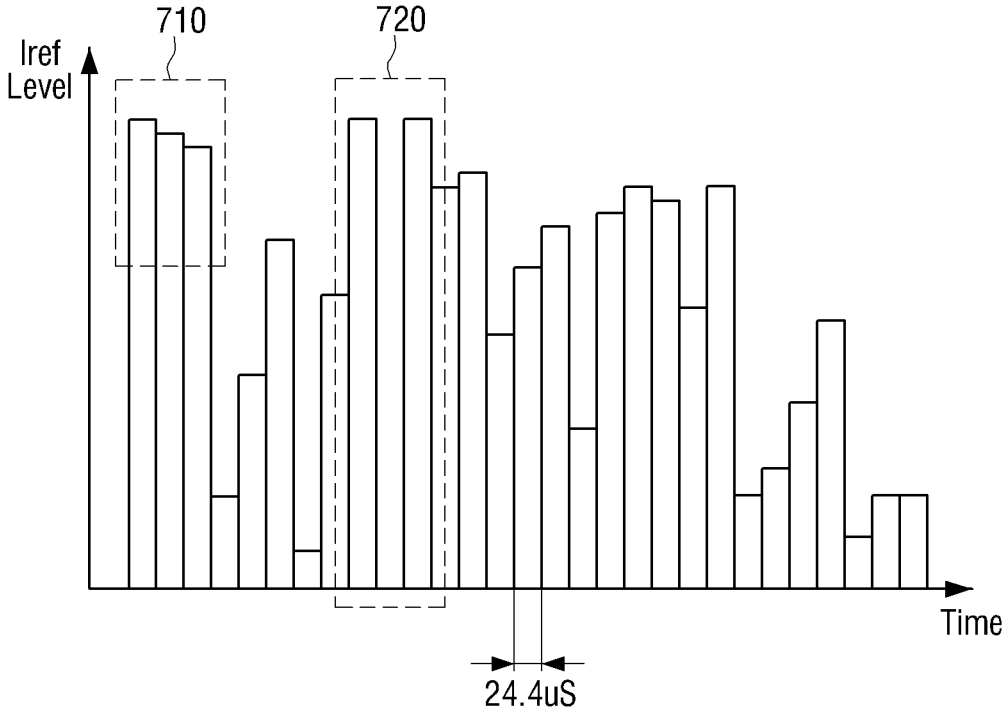
FIG. 7 is a graph illustrating an example of timing of a reference current according to an exemplary embodiment.
Figure 8A:
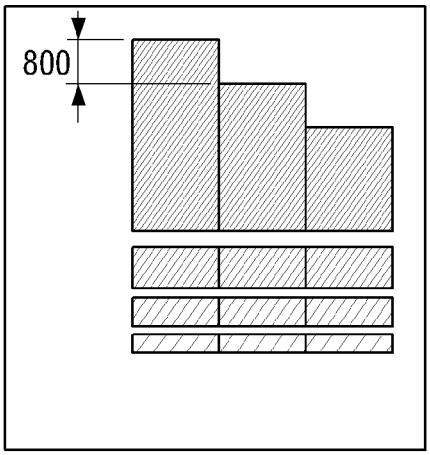
FIGS. 8A and 8B are graphs illustrating part of timing of a reference current in detail according to an exemplary embodiment.
Figure 8B:
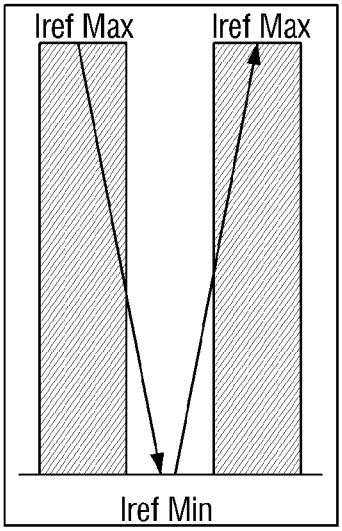

Hereinafter, an example of a change in the reference current Iref is described with reference to FIG. 7 and FIGS. 8A and 8B. FIG. 7 is a graph illustrating an example of timing of a reference current according to an exemplary embodiment. FIGS. 8A and 8B are graphs illustrating part of timing of a reference current in detail according to an exemplary embodiment.

As shown in FIG. 7, the reference current is variably generated with time. As shown in FIG. 7, the timing of the reference current is 24.4 μs. That is, the reference current is generated every 24.4 μs.

FIG. 8A is a graph enlarging the first area 710 of FIG. 7. In FIG. 8A, reference numeral 800 indicates a minimum change in the reference current. The minimum change 800 in the reference current means a current value which changes when the state of a single LED array 240 changes. That is, the minimum change 800 in the reference current is equal to I which is a current value necessary for a single LED array.

FIG. 8B illustrates the level of reference current which is changed from the maximum value to the minimum value and then is changed again to the maximum value. The reference current has the maximum value when the N LED arrays 240 are all turned on. The reference current has the minimum value when the N LED arrays 240 are all turned off. Even if the change in the current is great, the backlight apparatus 100 can adjust the amount of current to be supplied to the N LED arrays 240 by generating a reference current. Accordingly, the backlight apparatus 100 can provide local dimming.

Figure 9:
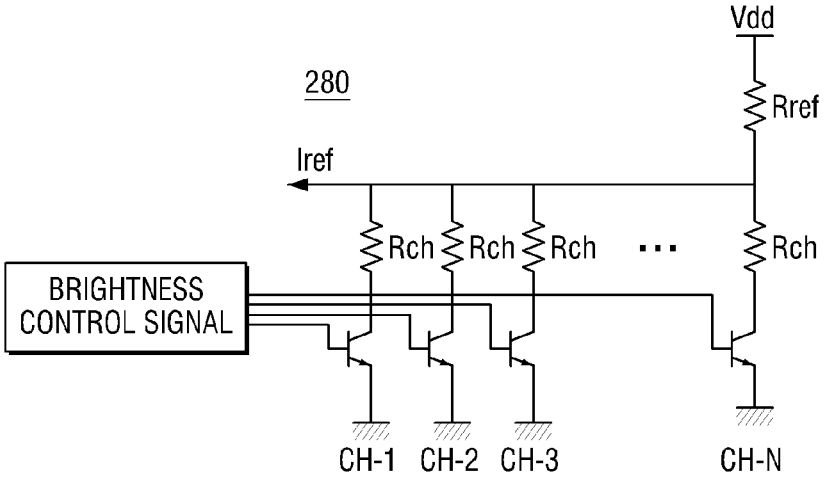
FIG. 9 is a circuit diagram illustrating a reference current generation unit according to an exemplary embodiment.

FIG. 9 is a circuit diagram illustrating the reference current generation unit 280 according to an exemplary embodiment. As shown in FIG. 9, the reference current generation unit 280 is implemented using a reference resistance Rref, N resistances Rch, and N transistor switches. The reference current generation unit 280 generates a reference current Iref corresponding to a brightness control signal by turning on or off the N transistor switches according to the brightness control signal.

Although the reference current generation unit 280 uses the N resistances having the same resistance value in this embodiment, it may be implemented using resistances having different resistance values. If the resistances having the different resistance values are used, the reference current generation unit 280 may be realized using the number of resistances which is less than the number N.

The reference current generation unit 280 shown in FIG. 9 is merely an example and any circuit that can generate a reference current corresponding to the brightness control signal can be applied as the reference current generation unit 280.

Figure 10:
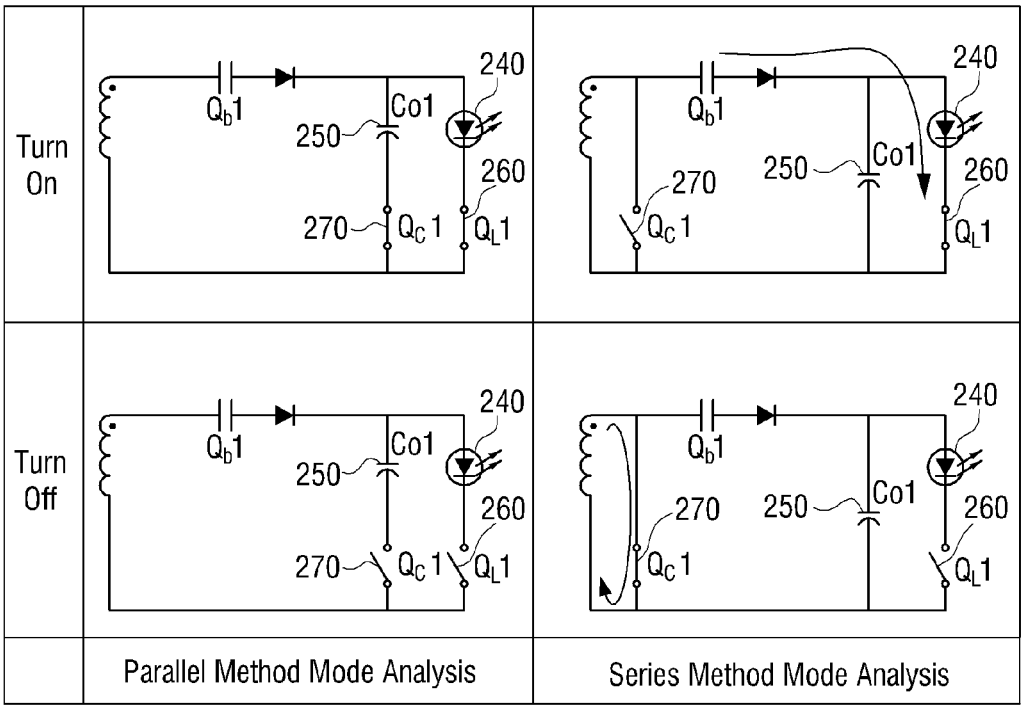
FIG. 10 is a view illustrating operations of a first switch unit and a second switch unit which are performed by turning on or off LED arrays according to an exemplary embodiment.

Hereinafter, the case in which the LED array 240 is turned on or turned off is described with reference to FIG. 10. FIG. 10 is a view illustrating operations of the first switch unit 260 and the second switch unit 270 when the LED array 240 is turned on or turned off.

If the LED array 240 is turned on in the case that the backlight apparatus 100 is in a parallel method mode as shown in FIGS. 3 and 5, both the first switch unit 260 and the second switch unit 270 are turned on, and, if the LED array 240 is turned off, both the first switch unit 260 and the second switch unit 270 are turned off.

If the LED array 240 is turned on in the case that the backlight apparatus 100 is in a series method mode as shown in FIGS. 4 and 6, the first switch unit 260 is turned on and the second switch unit 270 is turned off. On the other hand, if the LED array 240 is turned off, the first switch unit 260 is turned off and the second switch unit 270 is turned on.

Through the above-described process, the backlight apparatus 100 provides a local dimming function.

Figure 11:
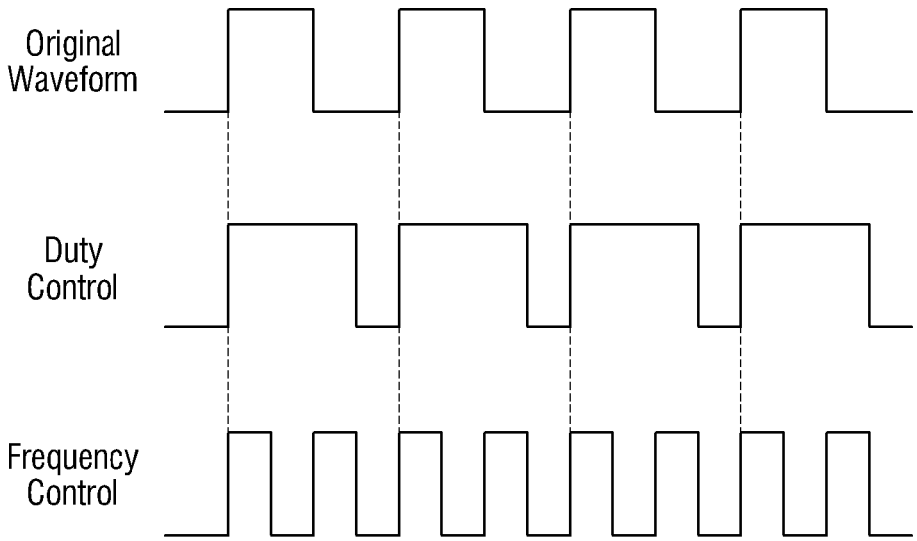
FIG. 11 is a view to explain a method for adjusting a current by an inverter unit according to an exemplary embodiment.

FIG. 11 is a view to explain a method for adjusting a current by the inverter unit 210 according to an exemplary embodiment. FIG. 11 illustrates waveforms of a current when the inverter unit 210 controls the duty or frequency of the current.

The duty means a ratio of on-time to off-time at the pulse and controlling the duty means controlling to change the on-off time of an original waveform. Accordingly, if the duty is controlled, the time at which the upper switch S1 is turned on and the lower switch S2 is turned off becomes different from the time at which the upper switch S1 is turned off and the lower switch S2 is turned on such that the waveform of a supplied current changes.

Also, if the frequency is controlled, the frequency in which the upper switch S1 is turned on and the lower switch S2 is turned off or the frequency in which the upper switch S1 is turned off and the lower switch S2 is turned on is repeated faster or slower such that the frequency of a supplied current changes.

As described above, the inverter unit 210 can adjust the current value of the supplied current according to the reference current.

Up to now, necessary configuration and function of the backlight apparatus 100 for the local dimming function is described.

Figure 12:
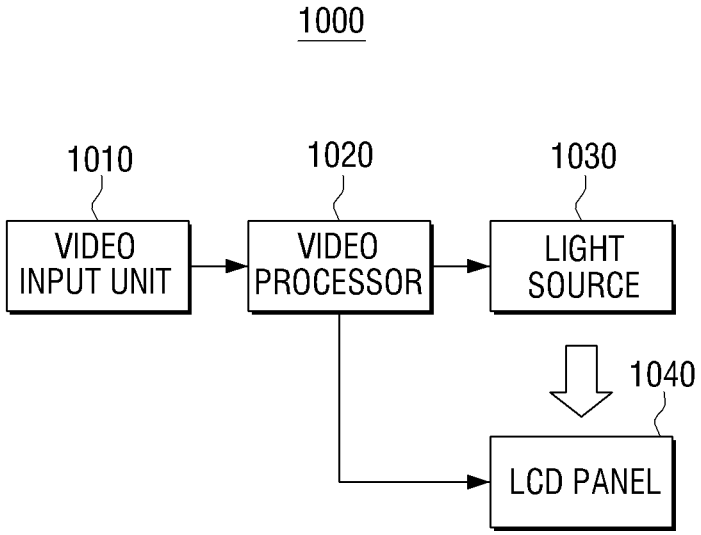
FIG. 12 is a block diagram illustrating a display apparatus according to an exemplary embodiment.

Hereinafter, a display apparatus 1000 to which the backlight apparatus 100 described above is applied is described with reference to FIG. 12. FIG. 12 is a block diagram illustrating a display apparatus 1000 according to an exemplary embodiment. In this embodiment, the display apparatus 1000 is a LCD display apparatus by way of an example.

As shown in FIG. 12, the LCD display apparatus 1000 includes a video input unit 1010, a video processor 1020, a light source 1030, and a panel 1040.

The video input unit 1010 includes an interface to be connected to an external device or an external system, and receives a video from the external device or the external system. The video input unit transmits the input video to the image processor 1020.

The image processor 1020 generates a video signal by converting the input video to have a format suitable for the LCD panel 1040, and generates a brightness control signal for local dimming of the light source 1030. The image processor 1020 generates a signal to perform the operations of the PFC unit 130, the SMPS unit 150, and the LED unit 170 of the backlight apparatus 100 described above, and transmits the signal to the light source 1030.

The light source 1030 is implemented by the backlight apparatus 100 including the PFC unit 130, the SMPS unit 150, and the LED unit 170 described above. The light source 1030 performs rectifying of input power, improving of a power factor, and current balancing to adjust the currents input to the LED arrays to be equal to one another, based on the signal received from the image processor 1020, and allows the N number of LED arrays to emit backlight. Also, the light source 1030 may provide a local dimming function using the above-described backlight apparatus 100.

The backlight emitted from the light source 1030 is transmitted to the LCD panel 1040. The LCD panel 1040 adjusts the permeability of the light generated by the light source 1030 to visualize the video signal, and displays the video signal on a screen. The LCD panel 1040 includes two substrates on which electrodes are arranged and which face each other, and is formed by injecting a liquid crystal material between the two substrates. If voltage is applied to the two substrates, an electric field is generated to move molecules of the liquid crystal material injected between the two substrates such that the permeability of the light is adjusted.

Although the light emitting element is an LED in the above embodiment, any other light emitting element which is capable of providing local dimming can be applied.

According to the various exemplary embodiments, since the backlight apparatus 100 including the N first switch units 260 to switch the currents flowing in the N LED arrays 240 according to the input brightness control signal, the N second switch units 270 to switch the currents flowing in the N capacitors 250 according to the input brightness control signal, and the reference current generation unit 280 to generate and output a reference current based on the input brightness control signal, and the display apparatus 1000 having the backlight apparatus 100 are provided, the brightness imbalance caused by distribution of the light sources and the difficulty in achieving lightness and slimness of the LCD panel are solved and the local dimming function is provided.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A backlight apparatus, comprising:

N light emitting element arrays, wherein each of the N light emitting element arrays comprises a predetermined number of light emitting elements, and N is a natural number greater than or equal to 1;

N capacitors which are connected in parallel to the N light emitting element arrays;

a brightness control signal input unit which receives a brightness control signal to adjust a brightness of the N light emitting element arrays;

N first switch units which switch a plurality of currents flowing in the respective N light emitting element arrays, according to the input brightness control signal;

N second switch units which switch a plurality of currents flowing in the respective N capacitors, according to the input brightness control signal;

a reference current generation unit which generates and outputs a reference current based on the input brightness control signal; and an inverter unit which receives a direct current (DC) from a power factor correction circuit and outputs an input alternating current (AC) and which adjusts a total current supplied to all of the light emitting element arrays in total to be equal to the reference current if the total current is different from the reference current, wherein each of the N first switch units is directly connected in series to a respective one of the N light emitting element arrays and is directly connected to the brightness control signal input unit.

2. The backlight apparatus as claimed in claim 1, wherein the reference current generation unit generates a reference current of an amount which is determined according to a number of light emitting element arrays that are turned on among the N light emitting element arrays, based on the input brightness control signal.

3. The backlight apparatus as claimed in claim 1, further comprising:

N balancing units which balance the alternating current by impedance balancing; and N rectification units which rectify the input alternating currents balanced by the N balancing units, thereby generating a direct current (DC) that is supplied to each of the N light emitting element arrays.

4. The backlight apparatus as claimed in claim 3, wherein the N balancing units are connected in parallel to one another.

5. The backlight apparatus as claimed in claim 4, wherein each of the N second switch units is connected in series to a respective one of the N capacitors.

6. The backlight apparatus as claimed in claim 1, further comprising a subtraction unit which outputs a differential current corresponding to a difference between the total current supplied from the inverter unit and the reference current generated by the reference current generation unit, and the inverter unit adjusts the total current according to the differential current.

7. The backlight apparatus as claimed in claim 1, wherein the inverter unit adjusts the total current by adjusting a duty or a frequency of the total current.

8. The backlight apparatus as claimed in claim 1, wherein the brightness control signal is a dimming or scanning signal.

9. The backlight apparatus as claimed in claim 1, wherein the light emitting element is a light emitting diode (LED).

10. A display apparatus comprising a backlight apparatus as claimed in claim 1.

11. A backlight apparatus, comprising:

N light emitting elements, wherein N is a natural number greater than or equal to 1;

N first switch units which each switch a current flowing in one of the N light emitting elements between an "on" state and an "off" state;

a brightness control signal input unit transmits a brightness control signal to each of the first switch units to control the brightness of each of the respective light emitting elements;

a reference current generation unit which receives the brightness control signal from the brightness control signal input unit and generates and outputs a reference current based on the "on" and "off" state of all of the N first switch units; and an inverter unit which receives a direct current (DC) from a power factor correction circuit and outputs an input alternating current (AC) and which adjusts a total current supplied to all of the N light emitting elements in total to be equal to the reference current if the total current is different from the reference current;

wherein each of the N first switch units is directly connected in series to a respective one of the N light emitting elements and is directly connected to the brightness control signal input unit.

12. The apparatus according to claim 11, wherein each of the N light emitting elements comprises a red light emitting diode, a green light emitting diode, and a blue light emitting diode.

13. The backlight apparatus as claimed in claim 12, further comprising:

N balancing units which balance the alternating current (AC) by impedance balancing; and N rectification units which rectify the input alternating currents balanced by the N balancing units, thereby generating a direct current (DC), and supply the DC that is supplied to each of the N light emitting element arrays.

14. The apparatus according to claim 13, wherein the N balancing units are connected in parallel to one another, and wherein each of the N second switch units is connected in series to a respective one of the N capacitors.

15. The apparatus according to claim 13, wherein the N balancing units are connected in series to one another, and each of the N second switch units is connected in parallel to a respective one of the N capacitors.

16. The apparatus according to claim 11, further comprising N capacitors which are each connected in parallel to one of the N light emitting elements.

17. The apparatus according to claim 16, further comprising N second switch units which each switch a current flowing in the N capacitors between an "on" state and an "off" state, wherein the brightness control unit transmit the brightness control signal to each of the N second switch units to control the N second switch units.

18. The apparatus according to claim 11, further comprising a subtraction unit which outputs a differential current corresponding to a difference between the total current supplied from the inverter unit and the reference current generated by the reference current generation unit, and the inverter unit adjusts the total current according to the differential current.

* * * * *